United States Patent [19]

Calabro

[11] Patent Number: 4,477,949

[45] Date of Patent: Oct. 23, 1984

[54] BELT BUCKLE CONSTRUCTION

[76] Inventor: Anthony S. Calabro, 51 Arbor Dr., Providence, R.I. 02908

[21] Appl. No.: 485,741

[22] Filed: Apr. 18, 1983

[51] Int. Cl.[3] ..... A44B 11/00; A44B 11/20

[52] U.S. Cl. ..... 24/180; 24/185; 24/186

[58] Field of Search ..... 24/163 R, 163 K, 173, 24/174, 176, 183, 185, 186, 180; 2/325, 311

[56] References Cited

U.S. PATENT DOCUMENTS

| | | | |
|---|---|---|---|
| 280,319 | 6/1883 | McCloskey et al. | 24/180 |
| 324,921 | 8/1885 | Cooper | 24/180 |
| 495,899 | 4/1893 | Monday | 24/180 |
| 737,448 | 8/1903 | McCrossin | 24/176 |
| 846,476 | 3/1907 | Hynard et al. | 24/176 |
| 1,062,715 | 5/1913 | Kjelden | 24/176 |
| 1,134,686 | 4/1915 | Line | 24/177 |
| 1,511,665 | 10/1924 | Faulkner | 24/180 |
| 2,078,651 | 4/1937 | Crocker, Jr. | 24/180 |
| 3,043,037 | 7/1962 | Lesser et al. | 24/176 |
| 3,913,147 | 10/1975 | Ostrander | 24/186 |

FOREIGN PATENT DOCUMENTS

| | | | |
|---|---|---|---|
| 1376719 | 9/1964 | France | 24/186 |
| 1286712 | 8/1972 | United Kingdom | 24/186 |

*Primary Examiner*—Victor N. Sakran

*Attorney, Agent, or Firm*—Robert J. Doherty

[57] ABSTRACT

A belt buckle for use with a belt strap having a first end and a second end with the first end having at least one opening extending therethrough and the second end having a plurality of longitudinally spaced holes extending therethrough. The buckle is of two-piece construction including a base member and a top member, both of which have no undercut portions and thus can be simply formed by conventional die casting techniques. The base member forms a seat for the first strap end and the second strap end is adapted to extend therebeneath such that a pin downwardly extending from the top member is adapted to extend through the aligned strap holes (a slot in the seat portion of the base member is provided for this purpose) and thus serve to connect the buckle and belt straps in the desired fashion. The top member hingedly connects to a portion of an end wall upstanding from the base member.

11 Claims, 5 Drawing Figures

BELT BUCKLE CONSTRUCTION

BACKGROUND AND OBJECTS OF THE INVENTION

This invention deals with belt buckle constructions and particularly a belt buckle construction of the type in which there is no permanent connection with the belt strap with which it is adapted to be utilized and, accordingly, can be alternatively used with a plurality of such belts. More particularly the buckle construction of the present invention is adapted for use with belt straps having at least one hole provided through the first end thereof and a plurality of longitudinally spaced holes extending through the other end thereof.

Belt straps of such above-described general nature are well known and include constructions such as set forth in U.S. Pat. No. 1,062,715 issued May 27, 1913 to P. J. Kjelden, U.S. Pat. No. 1,134,686 issued Apr. 6, 1915 to G. H. Line, and U.S. Pat. No. 3,913,147 issued Oct. 21, 1975 to R. K. Ostrander. The belt constructions shown in these aforementioned patents are representative of those generally available and require that the belt construction be either mechanically preassembled as in the construction shown by Line or involve the use of relatively complex buckle components, that is, components including undercut portions which require complex molding tools. Generally buckle components which are mass produced are formed from metal molding processes, generally die casting, and components having undercut portions require complex three-part molds or dies which materially increases the cost of both the molds and the forming process necessary to cast the components of the buckle.

Accordingly, a desirable feature would be to enable a buckle construction to be formed of components which are entirely free from undercut portions and, accordingly, may be easily made by commonly used die casting processes without requiring elaborate and expensive three-part molds.

A further desirable feature of buckles of this general nature would be the ability to change decorative elements thereof, that is, without the necessity of forming an entirely new buckle construction.

These and other objects of the present invention are accomplished by the provision of the subject two-piece belt buckle construction comprising separate base and top members adapted for hinged temporary interconnection with each other. The base member has a generally planar plate including opposite generally flat upper and lower surfaces wherein that portion of the belt strap provided with at least one hole is adapted to rest on the upper surface and that end of the strap provided with the plurality of spaced holes is adapted to contact the lower surface. The plate is provided with a slotted opening such that the respective strap end holes are aligned with each other and a downwardly extending pin which is provided on the buckle top member extends downwardly through such holes. The buckle top member is maintained in position with the buckle base member by a temporary hinged connection thereto.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
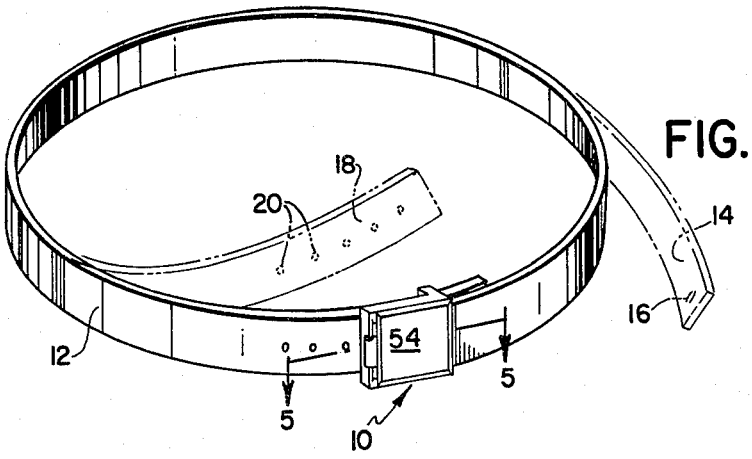
FIG. 1 is a perspective view showing the manner in which the belt construction of the present invention may be utilized in connection with a belt strap of conventional configuration, the opposite ends of which are also illustrated in phantom.
Figure 2:
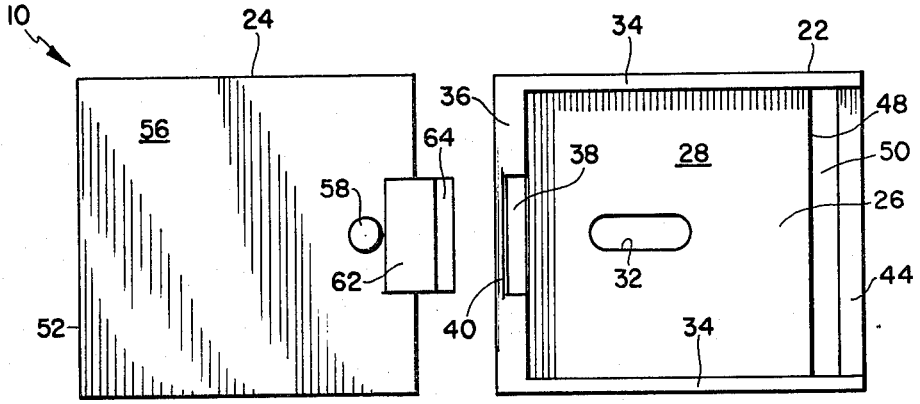
FIG. 2 is a top plan view of the buckle components of the present invention.

Turning now to the drawing, the buckle device 10 of the present invention is adapted for use with a belt strap 12 of conventional configuration. Accordingly and as best shown in FIG. 1 of the drawing, such belt strap 12 includes a first end 14 having a hole 16 therethrough and a second end 18 having a plurality of longitudinally spaced holes 20 therethrough. With other buckle constructions of this general type, the first end 14 of the belt strap 12 is adapted for receipt by the buckle the remainder of the strap and looped about the user's waist to encircle the same and thereafter a portion of the second strap end 18 inserted into the buckle. Thereafter a pin or other keeper element of the buckle construction is utilized to extend through aligned holes of the opposed strap ends so as to maintain the belt in the proper dimensioned loop as desired.

The construction of the device 10 of the present invention will now be explained by reference to the drawing and particularly FIGS. 2 through 5 thereof. The buckle device 10 includes a base member 22 and a top member 24 adapted to hingedly connect thereto and be easily separated therefrom. Generally both members are die-cast from metal although other materials and particularly materials which lend themselves to high speed molding techniques such as plastics may be used. The base member 22 includes a generally rectangular planar plate 26 having an upper surface 28 and a lower surface 30. An elongated slot 32 extends therethrough in a generally central position. The upper surface 28 of the plate 26 is surrounded on three sides by a wall or wall portions formed by a pair of upstanding side flanges 34 and an end flange 36. The end flange or end wall 36 includes an open top slot 38 which in part defines a connecting member or bridge 40 which is disposed adjacent to but rearwardly of the slot 38 and, accordingly forms no undercut portion in the finished piece. As previously indicated, the front end of the plate 26 is open to receive the first strap end 14 which is in turn adapted to abut against the inner surface 42 of the rear wall 36.

Figure 5:
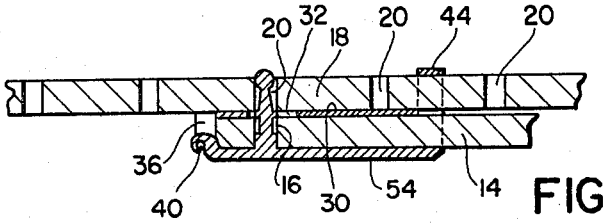
FIG. 5 is a side sectional view taken along the line 5—5 of FIG. 1 showing the completed buckle construction in operative position with the belt strap portions held thereby.
Figure 3:
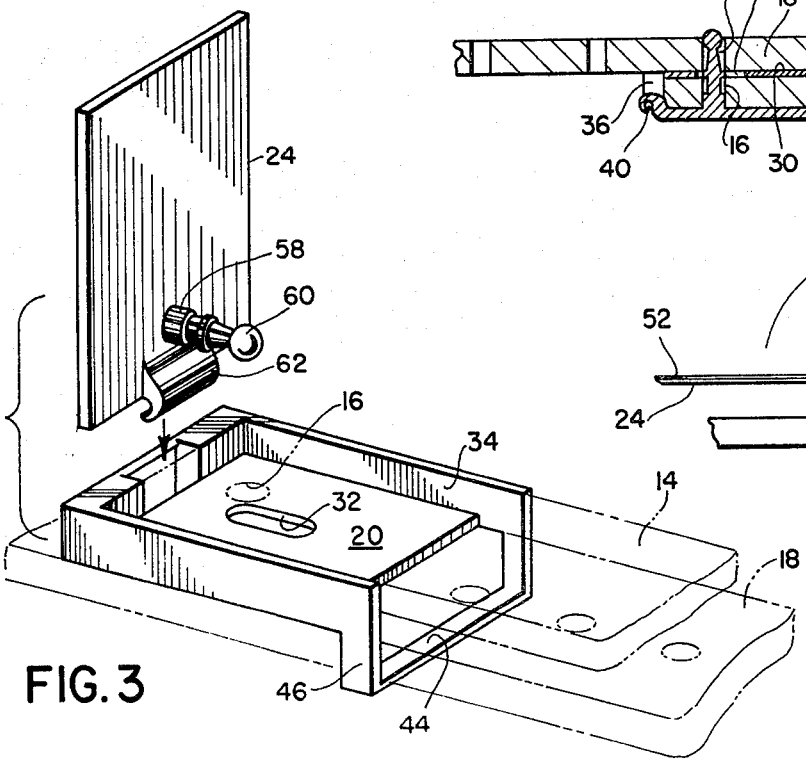
FIG. 3 is an exploded perspective view showing the manner in which component parts may be assembled to form the completed buckle assembly.
Figure 4:
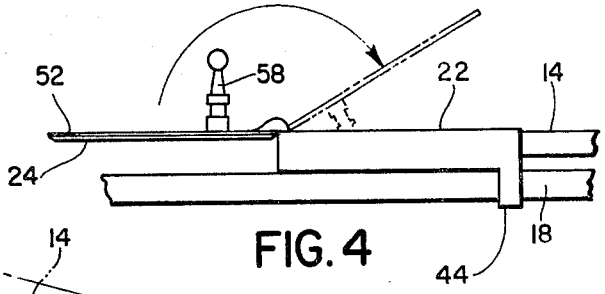
FIG. 4 is a side elevational view further illustrating the manner in which the buckle components cooperate to form the buckle structure.

In addition, the forward end of the base member 22 is provided with a loop-shaped keeper strap 44 including side arms 46 which are formed by extensions of the side flanges 34. In this manner then, the forward edge 48 of the plate 26 can be slightly rearwardly spaced from the strap 44 by a slot 50 thus further insuring the absence of any undercut portions on the base member 22. As best shown in FIGS. 3 through 5, the keeper strap 44 is adapted to engage portions of the second strap end 18 so as to insure such is disposed against the under surface 30 of the plate 26. From the above it may be apparent that the base member 22 may be made by die casting with a conventional two-piece mold inasmuch as it presents no undercuts necessitating complex mold parts. Accordingly, the base member as well as the top member 24 as will hereinafter be made apparent can be molded by conventional low cost techniques.

Turning now to the construction of the top member 24, such includes a generally planar body 52 of sheet-like configuration which may be provided at its outer surface 54 with decoration, e.g., bas-relief designs including initials and the like. The under surface 56 of the body 52 is unobstructed and is adapted to bear against the outer surface of the first belt strap end 14 with the exception of the provision of a downwardly extended pin 58 preferably terminating in an enlarged head 60. In addition thereto, the body 52 includes a rearwardly extending tongue 62 which terminates in an upwardly extending hook 64. The tongue 62 is adapted to extend into the slot 38 and the hook 64 engage under portions of the bridge member 40 such that the top member 24 may be hingedly engaged to the base member 24 in the intended manner, that is, easily connected to and disconnected from. Thereafter, the top member 24 is pivoted in the direction of the arrow in FIG. 4 such that the pin 58 extends through the hole 16, then the slot 32, and then the particular hole 20 aligned therewith such that the belt strap is fixed to a given desired dimension and held thereby by the clamping action of the buckle components.

It should also be made clear that the top member 24 is also free from undercut portions and may be easily die cast or molded using conventional two-part molds. It should also be apparent that various top members 24 with different decorations, colors, shapes, and the like may be provided for engagement with a common base member 22 and, accordingly, create the impression of having a plurality of belt buckles for different occasions but without the normal additive cost associated therewith.

While there is shown and described herein certain specific structure embodying this invention, it will be manifest to those skilled in the art that various modifications and rearrangements of the parts may be made without departing from the spirit and scope of the underlying invention concept and that the same is not limited to the particular forms herein shown and described except insofar as indicated by the scope of the appended claims.

What is claimed is:

1. A belt buckle for use with a belt strap having a first and a second end with said first end having at least one hole extending therethrough and said second end having a plurality of longitudinally spaced holes extending therethrough, said buckle comprising separate base and top members positively interconnectable with each other, said base member having a generally rectangular planar plate including opposite generally flat, upper and lower surfaces, said plate including an opening therethrough and wall portions at least including a rear end wall upstanding about said plate so as to form a seat for the terminal portion of said strap first end with said first end abutting said rear end wall whereby said first end terminal portion is positioned in said seat with the hole of said strap first end and said plate opening aligned with each other, said plate lower surface being accessible to and adapted to receive said strap second end with the upper surface thereof in face to face contact with said plate lower surface with one of said holes thereof aligned with said plate opening and said one strap first end hole, said buckle top member including a generally planar body having a pin downwardly extending from the lower surface thereof, said pin having means for engaging said base member plate adjacent said opening therethrough whereby said base and top members are positively positioned relative to each other, said top member further having a tongue rearwardly extending from for hingedly engaging said base member base wall whereby when said base and top members are interconnected said pin extends through said aligned holes sa as to position and clamp said belt strap ends therein.

2. The device as set forth in claim 1, said buckle base member further including a generally loop-shaped laterally oriented keeper strap downwardly extending from the front area of said plate for receipt of terminal portions of said strap second end.

3. The device of claim 1, said rear end wall having an open slot therein and adapted to receive said tongue therein.

4. The device of claim 3, said slot bridged by an upper connecting member, said tongue having a hook shaped terminus open at the upper end thereof and adapted to hingedly connect with said upper connecting member.

5. The device of claim 1, said wall portions including opposed upstanding side flanges and an upstanding rear end flange connected to and intermediate said side flanges, the front end of said plate being open to receive said first strap end.

6. The device of claim 2, said wall portions including opposed upstanding side flanges and an upstanding rear end flange connected to and intermediate said side flanges, the front end of said plate being open to received said first strap end, said keeper strap being forwardly offset and spaced from the front end of said plate and connected to said side flanges at opposite ends thereof.

7. The device of claim 1, said plate opening being a longitudinally oriented slot.

8. The device of claim 4, said upper connecting member rearwardly offset from said rear end wall such that said slot defined therein is of open top configuration.

9. The device of claim 1, said pin means for engaging said base member plate being a circular recess adapted to engage in said plate opening.

10. The device of claim 1, said pin terminating in an enlarged head, said head adapted to extend at least partially through the aligned hole of said strap second end so as to assist in clamping said strap ends in said buckle components.

11. A belt buckle for use with a belt strap having a first and a second end with said first end having at least one hole extending therethrough and said second end having a plurality of longitudinally spaced holes extending therethrough, said buckle comprising separate base and top members adapted for interconnection to each other, said base member having a generally rectangular planar plate including opposite generally flat, upper and lower surfaces, said plate including an opening therethrough and wall portions at least including a rear end wall upstanding about said plate so as to form a seat for the terminal portion of said strap first end with said first end abutting said rear end wall whereby said first end terminal portion is positioned in said seat with the hole of said strap first end and said plate opening aligned with each other, said plate lower surface being accessible to and adapted to receive said strap second end with the upper surface thereof in face to face contact with said plate lower surface with one of said holes thereof aligned with said plate opening and said one strap first end hole, said buckle top member including a generally planar body having a pin downwardly extending from the lower surface thereof, said top member further having means for interconnection with said base member base wall extending therefrom whereby when said base and top members are interconnected said pin extends through said aligned holes so as to position said belt strap ends thereto, said interconnection between said base and top members being a hinged connection, said top member having a tongue rearwardly extending therefrom, said rear end wall having an open slot therein and adapted to receive said tongue therein, said slot bridged by an upper connecting member, said tongue having a hook-shaped terminus open at the upper end thereof and adapted to hingedly connect with said upper connecting member.

* * * * *